US007007410B2

(12) United States Patent
Auger et al.

(10) Patent No.: US 7,007,410 B2
(45) Date of Patent: Mar. 7, 2006

(54) ARTICLE OF FOOTWEAR HAVING A REGIONAL CLEAT CONFIGURATION

(75) Inventors: Perry Auger, Tigard, OR (US); Troy Lindner, St. Michael, MN (US); Peter A. Hudson, Portland, OR (US)

(73) Assignee: Nike Inc., Beaverton, OR (US)

( * ) Notice: Subject to any disclaimer, the term of this patent is extended or adjusted under 35 U.S.C. 154(b) by 0 days.

(21) Appl. No.: 10/179,013

(22) Filed: Jun. 26, 2002

(65) Prior Publication Data

US 2004/0000071 A1 Jan. 1, 2004

(51) Int. Cl.
*A43B 5/00* (2006.01)
*A43C 15/02* (2006.01)
*A43C 15/16* (2006.01)

(52) U.S. Cl. ..... 36/59 R; 36/67 A; 36/116; 36/134

(58) Field of Classification Search ..... 36/59 R, 36/62, 67 A, 116, 74, 64, 65, 126, 127, 128, 36/59 C, 66, 134
See application file for complete search history.

(56) References Cited

U.S. PATENT DOCUMENTS

| | | | | | |
|---|---|---|---|---|---|
| 814,474 | A | * | 3/1906 | Pierce | 36/128 |
| 1,087,212 | A | * | 2/1914 | Caldwell | 36/126 |
| 1,867,219 | A | * | 7/1932 | Harper | 6/126 |
| 2,002,864 | A | * | 5/1935 | Nichols | 36/126 |
| 2,268,992 | A | * | 1/1942 | Nofziger | 36/126 |
| D136,208 | S | * | 8/1943 | Ghez et al. | 36/126 |
| 2,888,756 | A | * | 6/1959 | Parsons | 36/126 |
| 3,063,171 | A | * | 11/1962 | Hollander | 36/128 |
| 4,315,374 | A | | 2/1982 | Sneeringer | |
| 4,347,674 | A | | 9/1982 | George | |
| 4,392,312 | A | * | 7/1983 | Crowley et al. | 36/67 R |
| 4,393,604 | A | * | 7/1983 | Crowley | 36/67 R |
| 5,201,126 | A | | 4/1993 | Tanel | |
| 6,016,613 | A | | 1/2000 | Campbell et al. | |
| 6,108,943 | A | | 8/2000 | Hudson et al. | |
| 6,145,221 | A | | 11/2000 | Hockerson | |
| 6,182,381 | B1 | * | 2/2001 | Kancko et al. | 36/126 |
| 6,412,196 | B1 | * | 7/2002 | Gross | 36/59 R |
| 6,615,512 | B1 | * | 9/2003 | Sink | 36/127 |

OTHER PUBLICATIONS

Fogdog Sports; Fogdog Product Guide; Fogdog, Inc., 1998-2000.

* cited by examiner

*Primary Examiner*—Anthony Stashick
(74) *Attorney, Agent, or Firm*—Banner & Witcoff

(57) ABSTRACT

An article of cleated footwear comprises an upper for holding a foot of a wearer to a sole having an outsole plate. The outsole plate includes a predetermined first metatarsal region that generally overlies the respective skeletal structure of a human foot. Several ground engaging members extend downwardly from the outsole plate to provide traction on a ground surface. The outsole plate includes a downwardly extending metatarsal head cradle located on a lateral side and a medial side of the first metatarsal region to reduce stud pressure and provide traction control. The outsole plate may include a distal phalanx region and a predetermined proximal phalanx region. A first ground engaging member is located in the distal phalanx region and a second ground engaging member is located in the proximal phalanx region for toe off movements.

12 Claims, 7 Drawing Sheets

ARTICLE OF FOOTWEAR HAVING A REGIONAL CLEAT CONFIGURATION

FIELD OF THE INVENTION

The present invention generally relates to an article of footwear. More specifically, the invention relates to an article of footwear designed to address motions prevalent in the sport of soccer by enhancing performance and preventing injuries.

BACKGROUND OF THE INVENTION

Consumers and athletes purchase footwear for use in athletic activities such as running, cross training, soccer, football, baseball, basketball, tennis, walking. The shoes can affect the performance and contribute to their overall success in an athletic event for the wearer. Cleated athletic shoes, and particularly soccer shoes, conventionally include a sole and an upper extending upwardly from the sole and into which the foot of the athlete is positioned and secured in place. In addition, cleats are secured to the sole and extend downwardly from the sole to provide the traction of the shoe when the athlete runs. In conventional cleated shoes, the shape and location of the cleats are generally uniform throughout the sole. Such designs, however do not address the demands and requirements of the sport they relate for performance and reduction of injury for the athlete.

Conventional soccer shoes suffer from several drawbacks. One drawback of these shoes concerns increased impact force acting on the foot at the discrete cleat locations. This problem generally results from the relatively high ground impact forces that the shoe experiences when the athlete runs over firm ground playing fields/artificial turf or during foot planting movements. In general, the interaction of the forces on the sole causes adverse reactions, such as deforming and pressing upwardly against the bottom of the athlete's foot. This reactive action undesirably creates a condition known as "point loading" or "stud pressure" on the bottom of the athlete's foot at the discrete cleat locations. Over a period of continual use, this point loading may result in foot discomfort, fatigue, and inefficiency of footwork action.

A particular problem occurs in the forefoot area or forward portion of the conventional soccer shoes. The metatarsal bones have a forwardly disposed head portion that is susceptible to injury, in particular, the first metatarsal head. The interaction of impact forces, transferred through a cleat or a number of cleats may adversely affect the first metatarsal head. Unfortunately, some designs can cause additional injuries to the foot due to the excessive point loading from the cleats. Continual impact of the cleats into the ground may aggravate bone soreness in the first metatarsal head. Undesirably, some athletes may reduce their foot strike when they run to avoid the soreness. The reduced foot strikes results in a loss of propulsion and foot stability. While a sockliner may be used to reduce the stud pressure, the sockliner does not enhance the cleat performance or remove all the force impact. Therefore, it is desirable to avoid this transfer stud pressure to reduce injury.

Another drawback of conventional cleated shoes involves cleats that may interfere with the flexibility movement of the phalanges bones and the metatarsal bones of a wearer's foot. This interference can cause discomfort, fatigue, and injury. It is desirable to not interfere with the running sequence, but to enhance performance by providing a shoe with cleats in positions relative to the bones that improves traction control. Thus, there is a need for an article of footwear that overcomes deficiencies of certain athletic shoes, including, but not limited to deficiencies found in conventional cleated shoes intended for the sport of soccer.

SUMMARY OF THE INVENTION

The present invention pertains to an improved article of cleated footwear that overcomes the deficiencies in certain athletic shoes including soccer shoes.

According to a first aspect of the present invention, a cleated article of footwear includes an upper for holding a foot of a wearer to a sole having a molded outsole plate. The outsole plate includes a predetermined first metatarsal region that generally overlies the respective skeletal structure of a human foot. Several ground engaging members extend downwardly from the outsole plate to provide traction on a ground surface. The outsole plate further includes a downwardly extending metatarsal head cradle located within a predetermined distance of a lateral side and a medial side of the first metatarsal region. In this way, injury and stud pressure is reduced for the first metatarsal head of the foot of the wearer.

According to a second aspect of the present invention, a cleated article of footwear includes an upper for holding a foot of a wearer to a sole having a molded outsole plate. The outsole plate includes a predetermined distal phalanx region and a predetermined proximal phalanx region that generally overlies the respective skeletal structure of a human foot. Several ground engaging members extend downwardly from the outsole plate to provide traction on a ground surface. The outsole plate further includes a first ground engaging member located in the distal phalanx region and a second ground engaging member located in the proximal phalanx region. In this manner, the toe off performance of a shoe of the wearer is enhanced.

The aspects of the present invention advantageously applies features and structures to the forces applicable to the different areas of the shoe, in order to enhance flexibility, balance control, propulsion, stability and support in the specific areas where needed. This, in turn, provides improved performance and minimizes injuries for the wearer.

These and other aspects, features and advantages of the present invention will be readily apparent and fully understood from the following detailed description of preferred embodiments, taken in connection with the appended drawings, which are included by way of example and not by way of limitation with regard to the claimed invention, in which like reference numerals identifying the elements throughout.

DETAILED DESCRIPTION OF THE PREFERRED EMBODIMENTS

Figure 1:
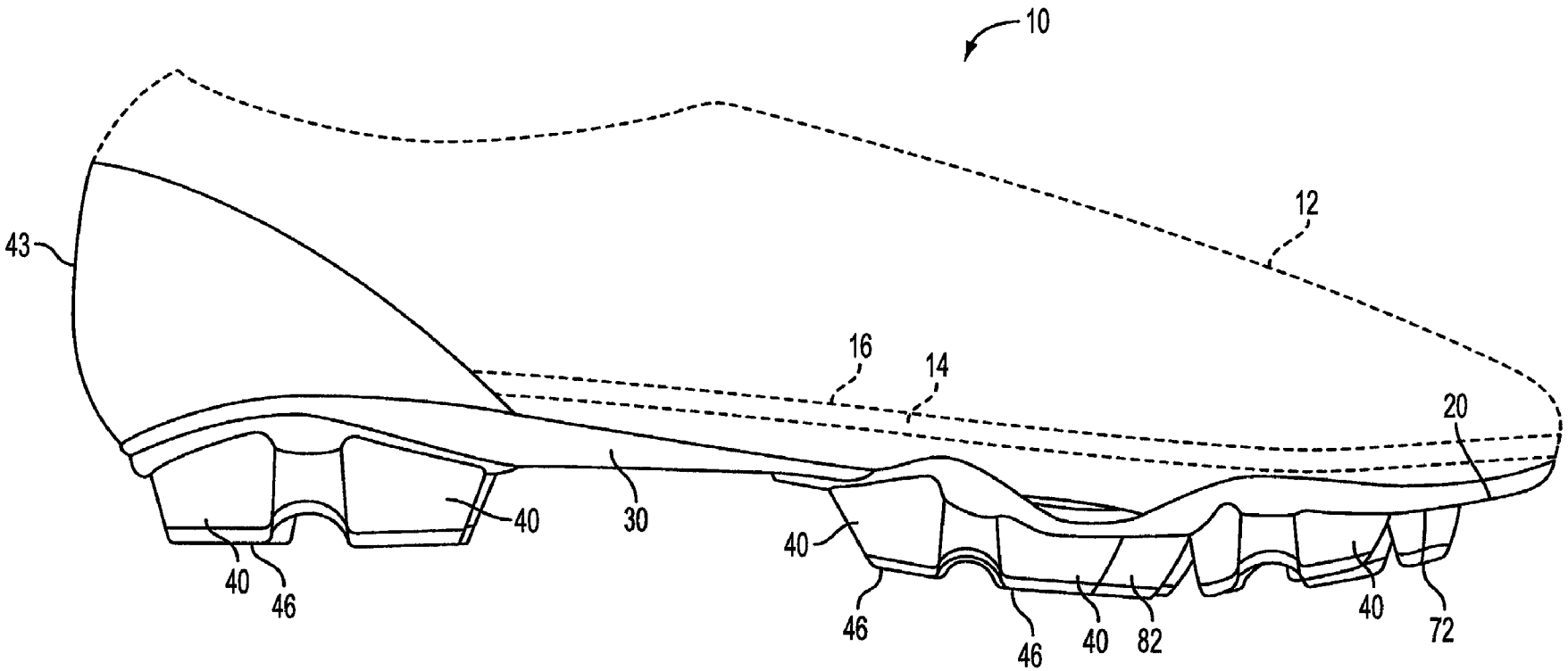
FIG. 1 is a schematic side elevational view of the lateral side of an article of footwear of the present invention.
Figure 2:
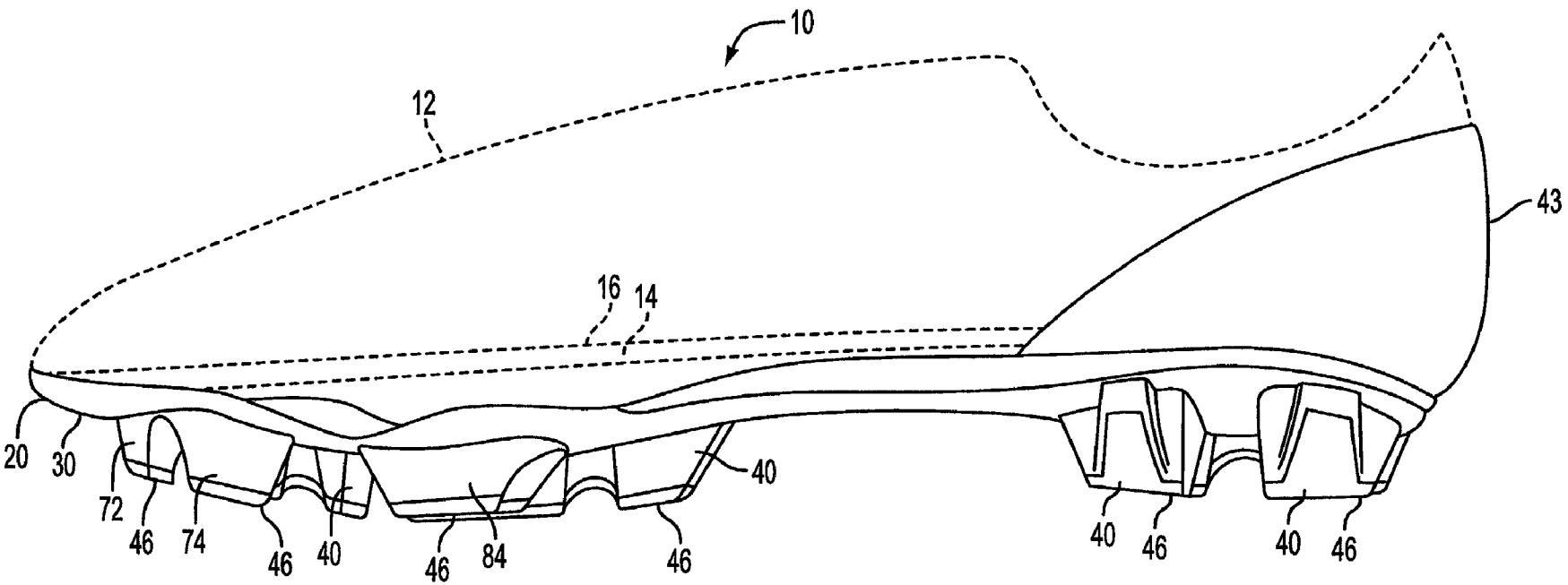
FIG. 2 is a schematic side elevational view of the medial side of the article of footwear of the present invention.
Figure 3:
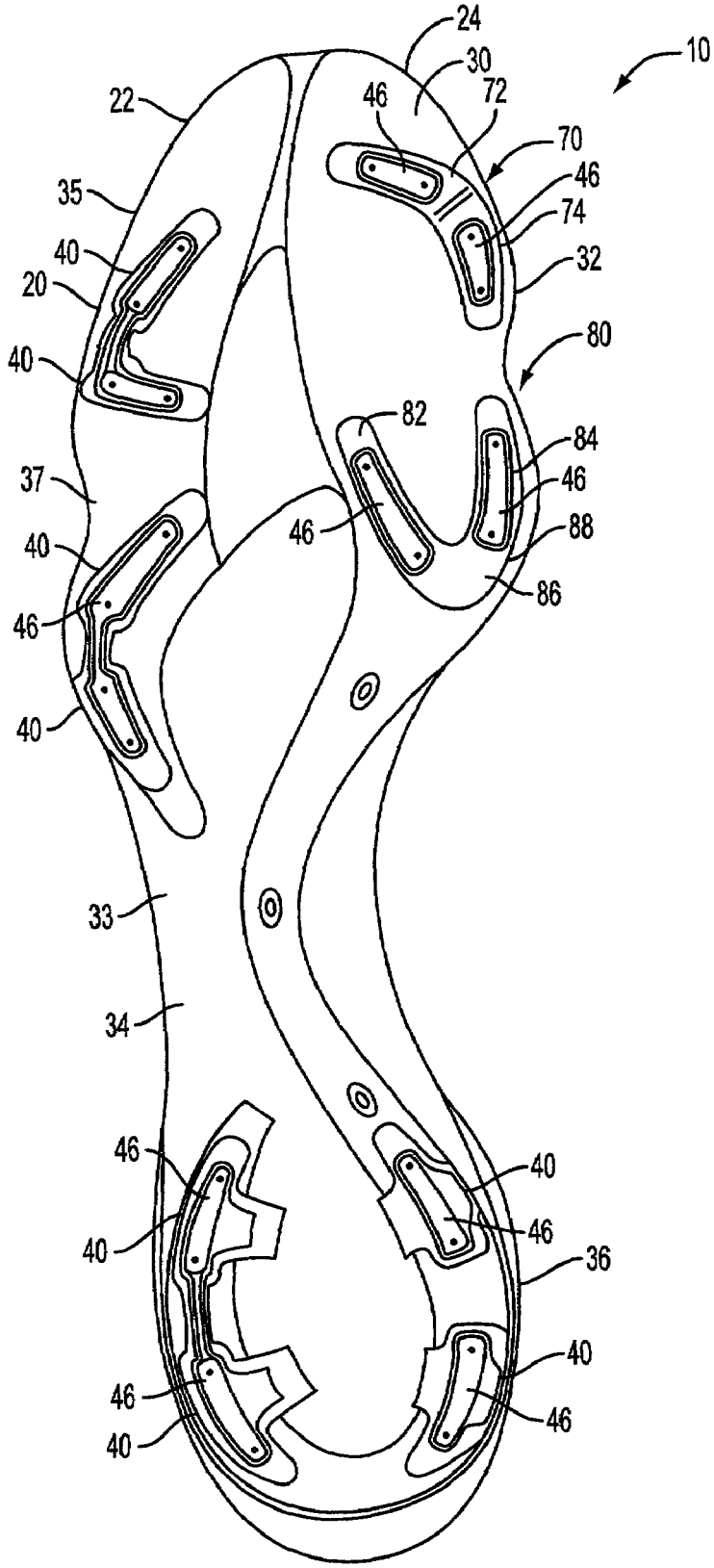
FIG. 3 is a schematic bottom plan view of the article of footwear of the present invention.
Figure 4:
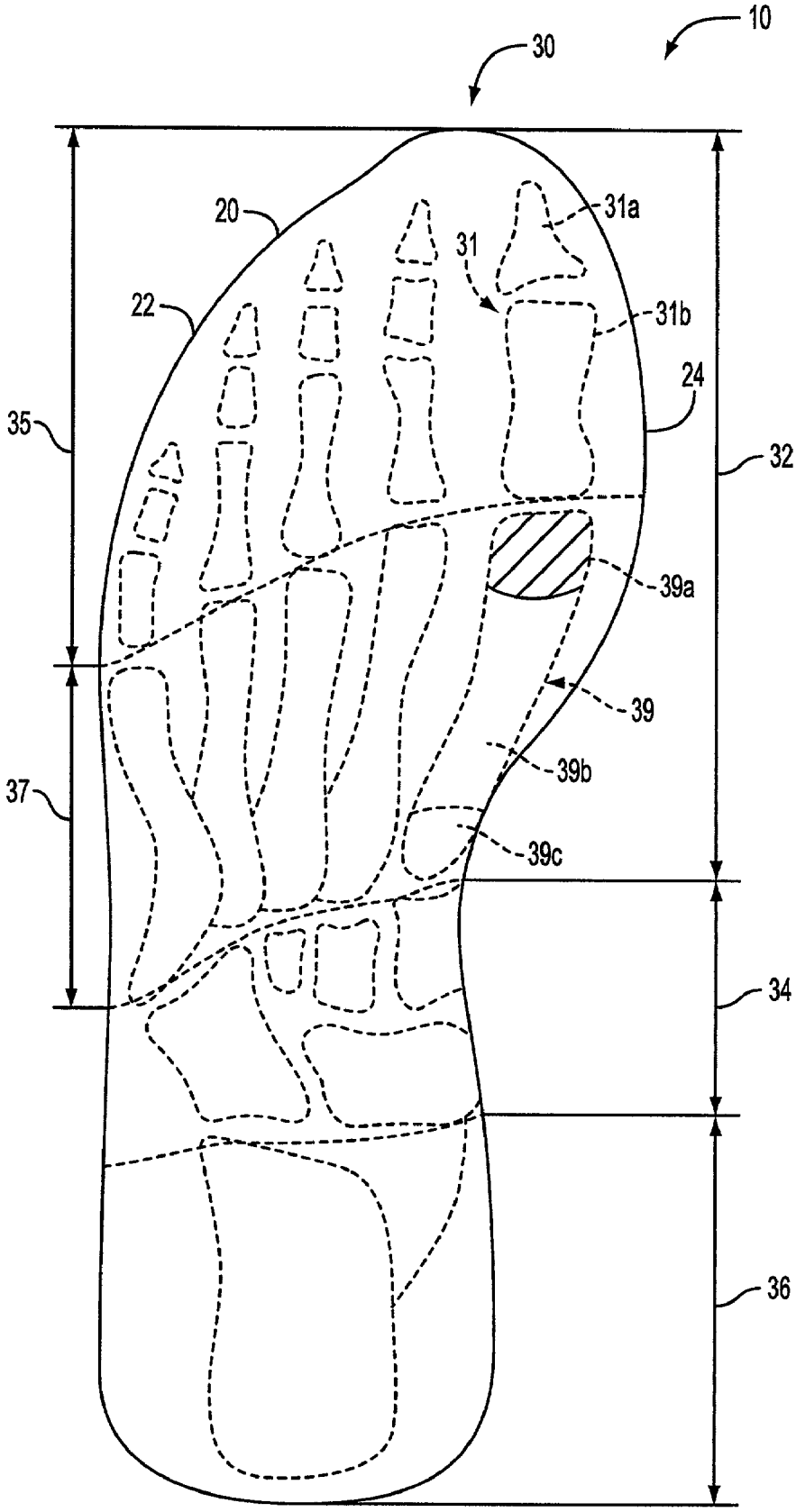
FIG. 4 is a schematic representation of the article of footwear illustrating a bottom plan view without cleats of an outsole plate with predetermined regions generally corresponding to the foot anatomy of a human body.

FIGS. 1–7 illustrate an embodiment of a cleated article of footwear, for example a soccer shoe. The article of footwear is generally referred to herein as a shoe 10. Shoe 10 includes an upper c12 that is attached to a sole 20 having a plurality of downwardly extending ground engaging members 40, 72, 74, 82, 84. In use, the ground engaging members generally penetrate downwardly into the underlying ground surface, such as grass, soil, or artificial turf. Shoe 10 may be preferably used to enhance performance in, and prevent injuries associated with, the sport of soccer. Referring to FIGS. 3 and 4, shoe 10 has a forefoot enhancing performance, in which the sole 20 includes a toe off structure 70 for improving traction control to increase the forward propulsion of the athlete. Additionally, sole 20 includes a metatarsal head cradle 80 for the first metatarsal bone of a foot of a wearer to reduce injury and stud pressure. Ground engaging members 82, 84 form part of the metatarsal head cradle 80 of sole 20. For ease of explanation regarding directions or orientation of components of the shoe 10, when the shoe 10 is worn, the lateral side 22 generally faces away from the centerline of a wearer's body. The medial side 24 generally faces inward towards the centerline of a wearer's body.

Referring to FIGS. 1–3, sole 20 includes an outsole plate 30 that extends along the sole in a conventional manner, such as the full length or substantially the length of the sole. Outsole plate 30 is typically made of a substantially abrasion resistance material. Outsole plate 30 can be formed by injection molding a plastic resin into a desired shape. If desired, the resin may be filled approximately 10% to 25% fiber material by volume to form a plastic resin composite. The plastic resin composite may be an enhanced resin having a filled fibrous composition, such as nylon, glass, or graphite fiber. The resin may be a polyester or a similar material. In one arrangement, the fibers can be oriented in a heel-to-toe direction. In another arrangement, the fibers may be a chopped type mixed in the resin. The arrangements provide a relatively stiff outsole withstanding abrasion and wear from the movements of the foot against ground surfaces. Nevertheless, other materials and methods can form outsole plate 30.

For a better understanding of the inventive cleated article of footwear, FIG. 4 illustrates a bottom plan view of outsole plate 30 including a schematical representation with predetermined regions or portions substantially corresponding to the foot anatomy of a human body. For ease of explanation regarding the preferred embodiment, the skeletal structure of a human foot includes three major divisions—the forefoot, the midfoot, and the rearfoot. The forefoot includes forward phalanges interconnected to metatarsal bones. The phalanges and metatarsals bones are formed in five rows in which the medial side starts the first row across to the fifth row on the lateral side of the foot. The heads of the metatarsal bones have a generally bulbous structure that is susceptible to injury in conventional cleated footwear. It should be recognized that the "great toe" structure is the first row, which includes two phalanges and a first metatarsal bone. The midfoot generally includes the arch formed by several interconnecting bones. Finally, the rearfoot includes the heel bone. One of ordinary skill in the art should recognize that foot anatomy also includes interconnecting muscles and other tissues, which are not shown for clarity.

With continued reference to FIG. 4, outsole plate 30 is defined by a forefoot region 32, a midfoot region 34 and a rearfoot region 36. One of ordinary skill in the art should recognize that each region generally lies beneath the respective forefoot, midfoot, and rearfoot of a wearer when shoe 10 is properly sized. In forefoot region 32, outsole plate 30 is further defined by a forwardly disposed phalanx region 35, and a rearward disposed metatarsal region 37. Phalanx region 35 includes at least a first phalanx region 31 having a distal phalanx region 31*a*, and a proximal phalanx region 31*b*. Metatarsal region 37 includes at least—a first metatarsal region 39 including anterior head region 39*a* connected to a shaft region 39*b*, and a rearward disposed base region 39*c*. It should be appreciated that metatarsal region 37 includes a second through fifth metatarsal region corresponding the second through fifth metatarsal bones. It should be recognized that these regions correspond to the typical anatomy of a human foot, which does not deviate significantly from the norm. The outsole plate 30 includes regions not specifically described as known to one of ordinary skill in the art.

Figure 5:
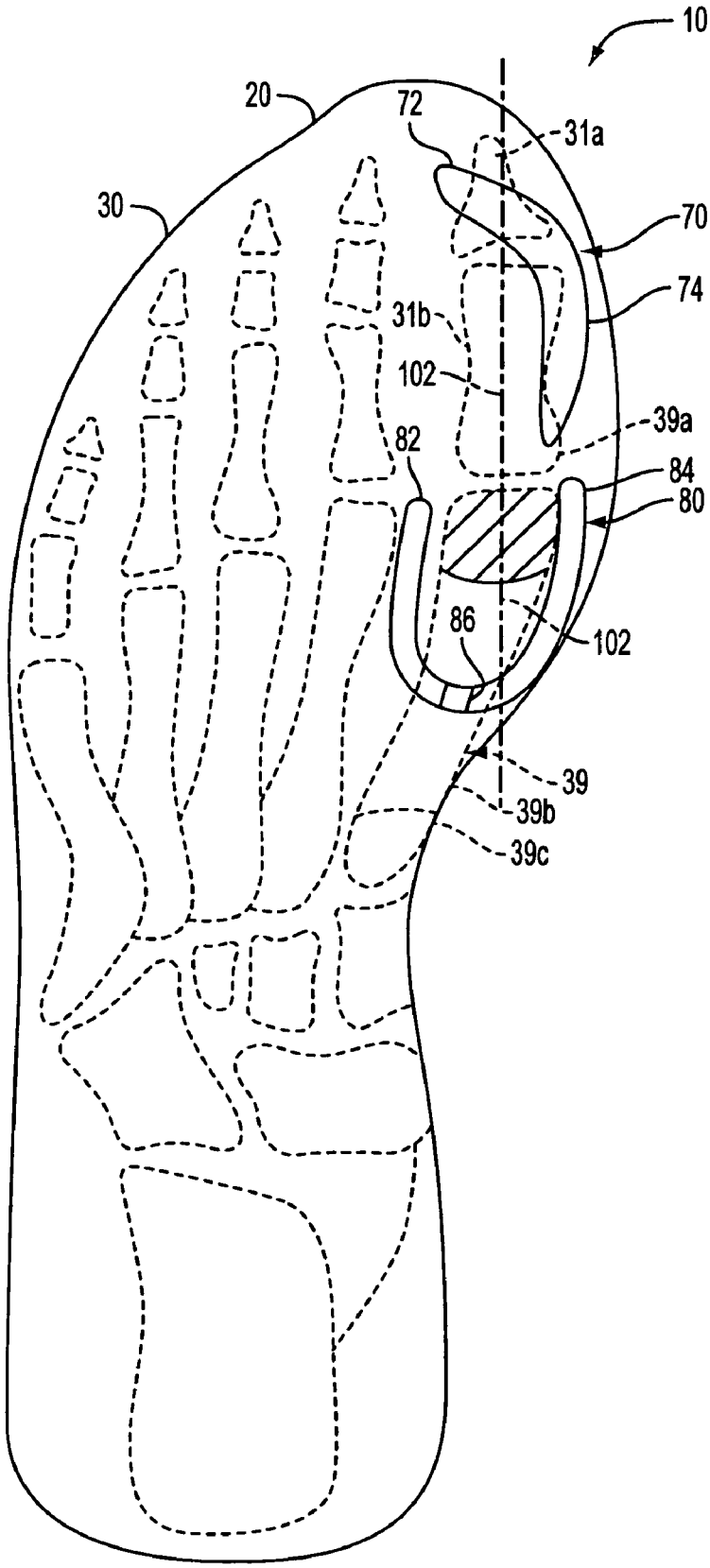
FIG. 5 is a schematic diagram of the article of footwear shown in FIG. 4 with a superimposition of a metatarsal cradle arrangement and a toe off arrangement.
Figure 6:
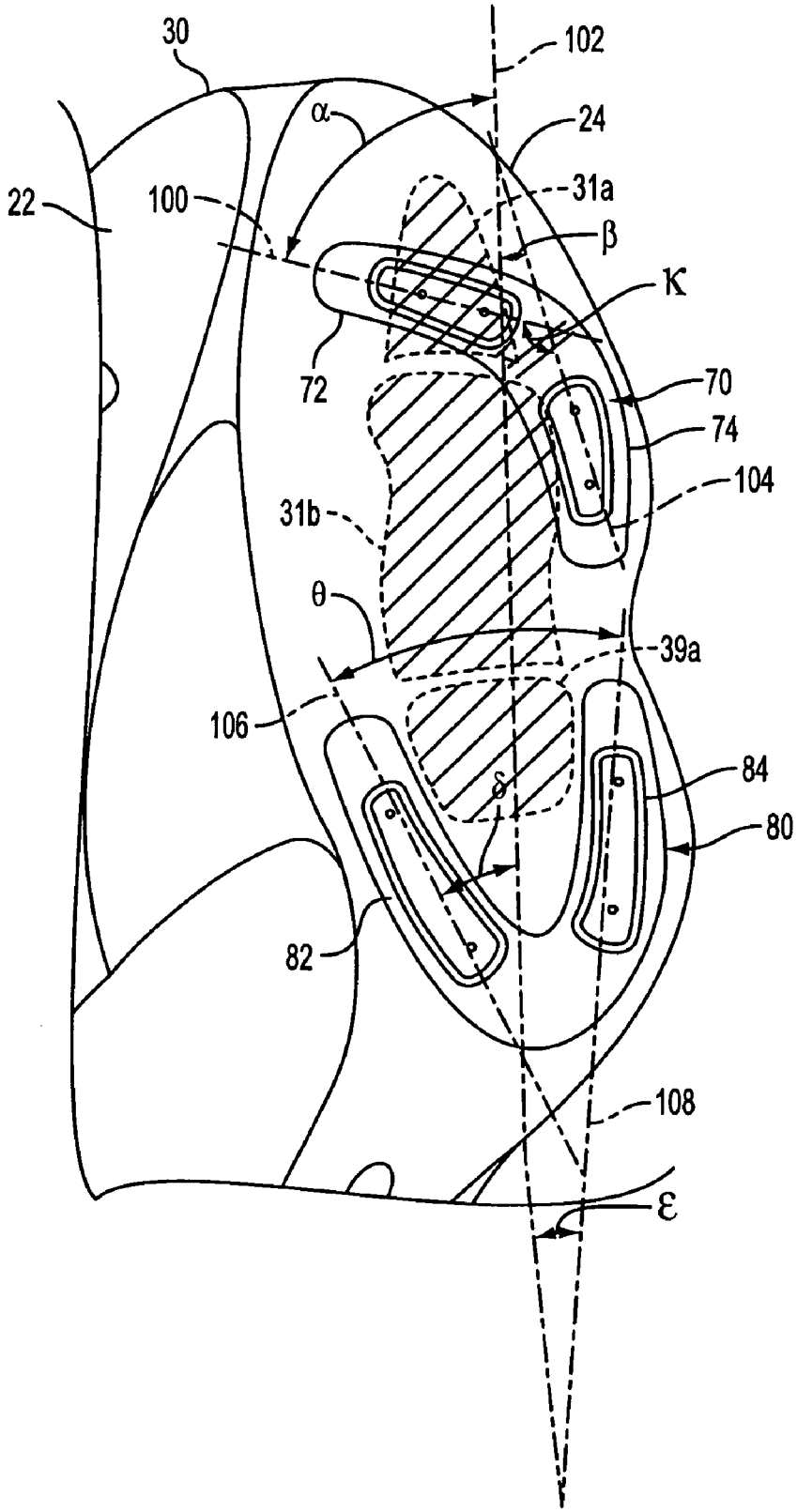
FIG. 6 is an enlarged schematic view of a forefoot portion of the article of footwear similar to FIG. 3.

In a preferred arrangement of shoe 10, as best seen in FIGS. 5 and 6, toe-off structure 70 of outsole plate 30 includes two forwardly located ground engaging members 72, 74 extending downwardly from distal phalanx region 31*a* and proximal phalanx region 31*b*, respectively. Toe-off structure 70 facilitates the use of the phalanx region 35 of outsole plate 30 in a forward motion. The toe-off structure helps ensure efficient transfer of the body weight to ground engaging members 72, 74 so as to improve the forward thrust or propulsion of the athlete. A heel-to-toe axis 102 is generally defined herein as the direction when a wearer of 10 is moving in a forward motion.

As been seen in FIG. 6, a first axis 100 is defined as an axis that extends along the length of ground engaging member 72 which generally bisects the width through member 72. Likewise, a second axis 104 is defined as an axis that extends along the length of ground engaging member 74 which generally bisects the width of ground engaging member 74. In this configuration, ground engaging member 72 may be disposed at an angle $\alpha$ toward the lateral side as measured relative from first axis 100 to a heel-to-toe axis 102 of outsole plate 30. Heel-to-toe axis 102 may generally extend though distal phalanx region 31*a* and proximal phalanx region 31*b* in the heel-to-toe direction. The angular dimension of angle $\alpha$ may range between 60–110 degrees, 70–100 degrees, and preferably between 80–90 degrees relative to heel-to-toe axis 102. In this arrangement, ground engaging member 72 extends in a side-to-side direction across distal phalanx region 31*a*. This orientation provides an improved base to penetrate a ground surface in a forward motion.

Ground engaging member 74 is disposed at an acute angle $\beta$ as measured relative from second axis 104 to heel-to-toe axis 102. The measurement of angle $\beta$ may range from 1–20 degrees, 7–12, and preferably between 3–14 degrees. The orientation of ground engaging member 74 may be generally parallel with respect to the heel-to-toe axis 102 of shoe 10. The arrangement supports the foot of the wearer in side-to-side or cutting motions and improves traction control. Furthermore, both ground engaging members 72, 74 are disposed at an angle $\kappa$ with respect to each other as measured from first axis 100 to second axis 104. The measurement of angle $\kappa$ ranges between 90–118 degrees, 100–110 and preferably 112–117 degrees. Both ground engaging members 72, 74 may be joined or may be separated.

FIGS. 3, 5 and 6 illustrate a preferred configuration of metatarsal head cradle 80. Cradle 80 includes an integral cleat structure located within a close proximal distance of the lateral side 22 and medial side 24 of first metatarsal region 39, including the head region 39*a*. The proximal distance can be adjacent to head region 39*a* within an operable range of greater than 0.10 mm but less than 5 mm. In a further arrangement, the operable range is greater than 0.10 but less than 3 mm and preferably less than 1 mm. The cleat structure of cradle 80 can be formed by ground engaging members 82, 84. Ground engaging member 82 is located on the lateral side of region 39*a* and member 84 is disposed on the medial side thereof. The pair of ground engaging members 82, 84 can be disposed in a spaced relationship having a medial-to-lateral orientation of approximately the width of the head region 39*a* and preferably spaced therefrom within the operable range. Each ground engaging member 82, 84 preferably extends generally from a distance as measured from a mid-portion of shaft region 39*b* to the outer tip of head region 39*a*.

As been seen in FIG. 6, a lateral cradle axis 106 is defined as an axis on the lateral side 22 of the first metatarsal region 39 that extends generally along the length of ground engaging member 82 disposed at the midpoint of the width through member 82. A medial cradle axis 108 is defined as an axis on the medial side 24 of the first metatarsal region 39 that extends along the length of ground engaging member 84 disposed at the midpoint of the width through member 84. Ground engaging member 82 is disposed at a generally acute angle $\delta$ toward the lateral side as measured relative from lateral cradle axis 106 to heel-to-toe axis 102 of outsole plate 20. Heel-to-toe axis 102 may generally extend through the first metatarsal head region 39*a* in the heel-to-toe direction. The angular dimension of angle $\delta$ may range between 25–40 degrees, 27–39 degrees, and preferably between 30–35 degrees relative to the heel-to-toe axis 102.

Similarly as member 82, ground engaging member 84 is disposed at a generally acute angle $\epsilon$ as measured relative from medial cradle axis 108 to heel-to-toe axis 102. The measurement of angle $\epsilon$ may range from 2–18 degrees, 5–12 degrees, and preferably between 6–10 degrees. Furthermore, both ground engaging members 82, 84 are disposed at a generally acute angle $\theta$ with respect to each other as measured from lateral cradle axis 106 to medial cradle axis 108. The measurement of angle $\theta$ may range between 27–58 degrees, 33–52 degrees, and preferably 36–45 degrees. In these orientations metatarsal head cradle 80 allows greater downward flexing of outsole plate 30 in the anterior head region 39*a* and elimination of direct transfer stud pressure while maintaining enhanced traction control.

Ground engaging members 82, 84 may be interconnected a downwardly extending connection portion 88 located at a predetermined point 86 in shaft region 39*b*. In general, the height of connection portion 88 can range from 5% to 25%, preferably from 10% to 20% of the height of the ground engaging members 82, 84 so as to not impede with the traction performance of shoe 10 while reducing stud pressure acting in the first metatarsal region. The stud pressure is reduced due to connection portion 88 reduced height to prevent transferred impact forces in shaft region 39*b* due to direct contact with the underlying ground surface. This arrangement continues the cradle arrangement for the first metatarsal head. It should be recognized that the height of the connection portion 88 can be measured relative to an average height of the ground engaging members 82, 84 or relative to the height of at least one of the members 82, 84.

With reference to FIGS. 3–6, the positioning of ground engaging members 82, 84 provide the wearer of shoe 10 with a high degree of flexibility and traction control. As can be appreciated, metatarsal head cradle 80 advantageously reduces the undesirable stud pressure acting on the foot of the wearer at the first metatarsal bone. In a preferred construction, the reduction of stud pressure is achieved by eliminating direct transferred impact forces against the bottom of the head of the first metatarsal bone. It should be recognized that the head region 39*a* of first metatarsal region 39 is devoid of a downwardly extending ground engaging member, but are in close proximity on lateral and medial sides to the region to provide traction control and stability for the foot.

Figure 7:
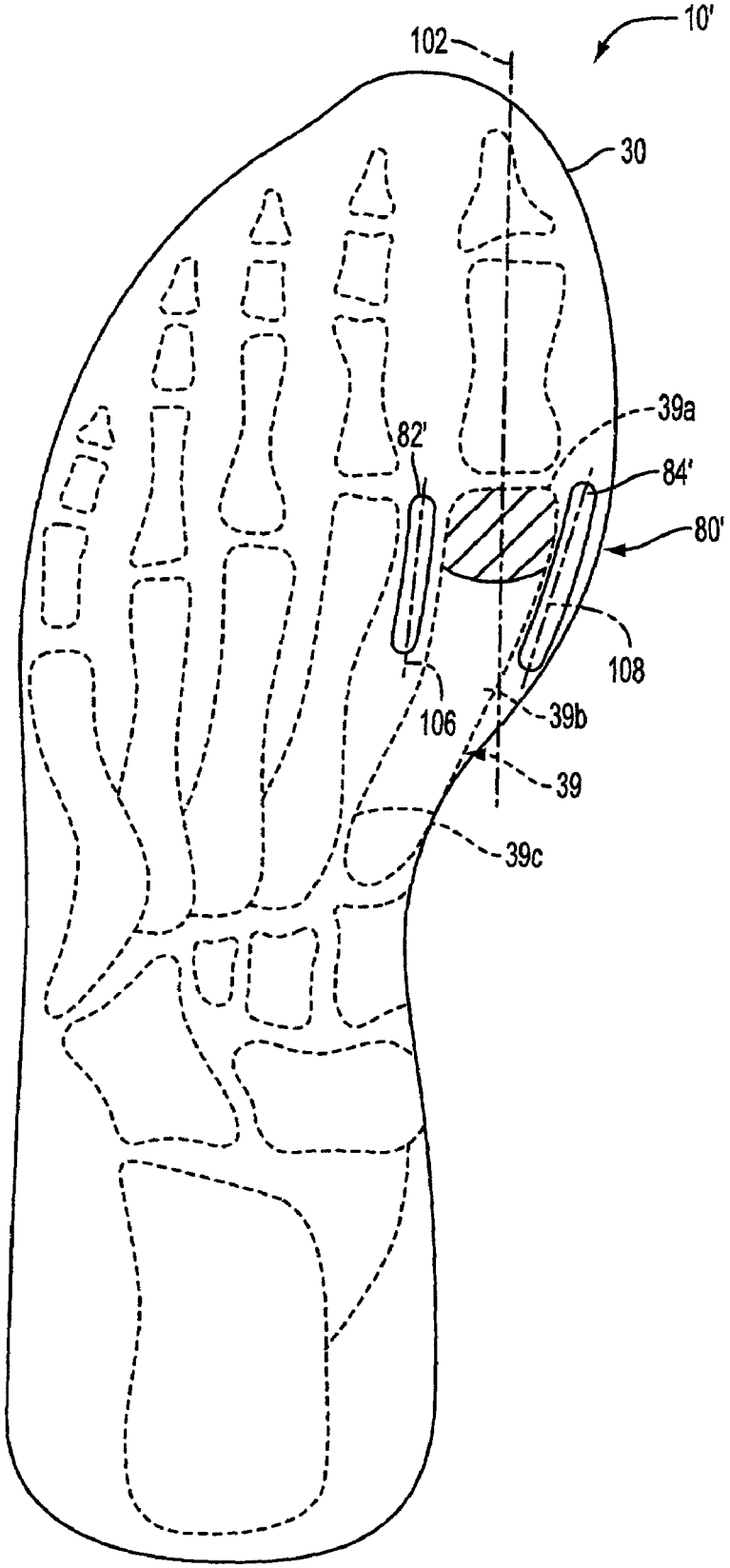
FIG. 7 is a schematic diagram similar to FIG. 5 illustrating an alternative embodiment of the metatarsal cradle of the present invention.

FIG. 7 illustrates an alternative embodiment of a cleated article of footwear 10' having a metatarsal head cradle 80' in which the lateral cradle axis 106 and medial cradle axis 108 are generally parallel. Accordingly, a pair ground engaging members 82', 84' forming cradle 80' are generally parallel. Members 82', 84' are disposed on lateral side 22 and medial side 24 with an operable range of first metatarsal region 39, including the head region 39*a*. In the illustrated embodiment, region 39 is devoid of members 82', 84'.

Another advantage of the present invention is that metatarsal head cradle 80 or 80' promotes flexibility of the interconnection between the proximal phalanx bone, and the first metatarsal bone during walking, running, or acceleration of the foot of the wearer. This flexing movement enables the ground engaging members 82 and 84 to reliably dig-in or penetrate into the underlying ground surface to perform improved traction control.

The ground engaging members 40, 72, 74, 82, and 84 may be any appropriate construction, such as removable, replaceable, adjustable and having the shapes shown in FIGS. 1–3 or other appropriate shapes. In a preferred construction, each ground engaging member projects downwardly from outsole plate 30 to a distal tip 46 in a generally perpendicular direction relative to a bottom surface 33 of outsole plate 30. Ground engaging members 40, 72, 74, 82, and 84 are preferably molded integrally with the outsole plate 30, either as part of the same initial mold or as an over-molded process, to provide a strong bond. If desired, the ground engaging member may be fastened, or adhesively bonded, or otherwise fixed to outsole plate 30.

In one arrangement, as shown in FIG. 3, ground engaging members 40, 72, 74, 82, and 84 may be elongated linearly such that the length, as measured generally parallel with respect to the bottom surface 33, is greater than the width. In one case, the length may range from 100% to 500% greater than the width, preferably from 200% to 400%. In this way, the toe-off structure with ground engaging members 72, 74 have an elongated support base for improved traction control. With regard to metatarsal head cradle 80, the elongated configuration provides more cleat material bordering first metatarsal region 39 to take advantage of the ground penetrating forces for traction control, but not increasing undesirable stud pressure on the anterior head of the first metatarsal bone.

With reference to FIGS. 1–2, if desired, shoe 10 may include an insole or a sockliner 14 disposed inside and is preferably positioned between the foot of the wearer and the sole 20. In addition, the sockliner 14 further comprises an upper surface defining a footbed 16, that is the portion of the shoe 10 that comes in contact with the bottom of the foot of the wearer. Sockliner 14 provides additional cushioning and shock absorption of the shoe 10. Sockliner 14 may be removable and replaceable from shoe 10. If desired, shoe 10 may also include a midsole for providing cushioning and support. Optionally, a heel cup 43 may be provided to firmly support the heel of the foot of the wearer during athletic activity.

In operation, the previously described features, individually and/or in any combination, improves stability and traction control of which are important sports needing cleated footwear. Further, the features of the shoe 10 reduce injury. While the various features of shoe 10 operate together to achieve the advantages previously described, it is recognized that individual features and sub-combinations of these features can be used to obtain some of the aforementioned advantages without the necessity to adopt all of these features.

While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention will include all embodiments falling within the scope of the appended claims.

What is claimed is:

1. An article of cleated footwear, comprising:

an upper for holding a foot of a wearer therein; and a sole attached to the upper, said sole having an outsole plate including a predetermined first metatarsal region, and a plurality of ground engaging members extending downwardly from the outsole plate configured to provide traction, said outsole plate including a downwardly extending metatarsal head cradle disposed on a lateral side and a medial side of the first metatarsal region, wherein the metatarsal head cradle further includes a lateral cradle member having a first concave sidewall on said lateral side and a medial cradle member having a second concave sidewall on said medial side, said first concave sidewall and the second concave sidewall facing each other so as to form a general U shape arrangement.

2. The article of cleated footwear of claim 1, wherein the predetermined first metatarsal region of said outsole plate further includes a metatarsal head region, and a shaft region.

3. The article of cleated footwear of claim 2, wherein said lateral cradle member and said medial cradle member are configured to extend along said outsole plate from said metatarsal head region to a predetermined distance of said shaft region.

4. The article of cleated footwear of claim 3, wherein said outsole plate further includes a heel-to-toe axis extending in a heel-to-toe direction generally within said first metatarsal region, and said lateral cradle member is oriented with respect to said heel-to-toe axis at a first angle ranging between 25–40 degrees.

5. The article of cleated footwear of claim 4, wherein said first angle ranges between 27–39 degrees.

6. The article of cleated footwear of claim 4, wherein said medial cradle member is oriented with respect to said heel-to-axis at a second angle ranging between 2–18 degrees.

7. The article of cleated footwear of claim 6, wherein said second angle ranges between 5–12 degrees.

8. The article of cleated footwear of claim 2, wherein said lateral cradle member and said medial cradle member are interconnected by a downwardly extending connection portion disposed in said shaft region.

9. The article of cleated footwear of claim 1, wherein said outsole plate further includes a distal phalanx region and a proximal phalanx region, said distal phalanx region having a first ground engaging member extending downwardly therefrom and said proximal phalanx region having a second ground engaging member extending downwardly therefrom.

10. The article of cleated footwear of claim 9, wherein said outsole plate further includes a heel-to-toe axis extending in a heel-to-toe direction generally within said distal phalanx region and said proximal phalanx region, said first ground engaging member being oriented with respect to said heel-to-toe axis at a first angle ranging between 70–110 degrees.

11. The article of cleated footwear of claim 10, wherein said second ground engaging member is oriented with respect to said heel-to-axis at a second angle ranging between 1–20 degrees.

12. The article of cleated footwear of claim 2, wherein said metatarsal head region is devoid of said ground engaging members.

* * * * *

UNITED STATES PATENT AND TRADEMARK OFFICE

CERTIFICATE OF CORRECTION

PATENT NO. : 7,007,410 B2
APPLICATION NO. : 10/179013
DATED : March 7, 2006
INVENTOR(S) : Perry Auger et al.

It is certified that error appears in the above-identified patent and that said Letters Patent is hereby corrected as shown below:

Title page,
Item [75], Inventors, replace "St. Michael, MN" with -- Portland, OR --; and insert -- Erez Morag, Lake Oswego, OR (US) --.

Signed and Sealed this

Fourth Day of July, 2006

JON W. DUDAS
*Director of the United States Patent and Trademark Office*